United States Patent [19]

Bellot

[11] 4,210,444

[45] Jul. 1, 1980

[54] MAGNESIUM-FREE, FINE-GRAINED STRUCTURAL STEEL WITH IMPROVED MACHINABILITY AND WORKABILITY

[75] Inventor: Jean Bellot, Pompey, France

[73] Assignee: Societe Nouvelle des Acieries de Pompey, Neuilly-sur-Seine, France

[21] Appl. No.: 911,113

[22] Filed: May 31, 1978

[30] Foreign Application Priority Data

Jun. 24, 1977 [FR] France ..... 77 19484

[51] Int. Cl.[2] ..... C22C 38/60

[52] U.S. Cl. ..... 75/124; 75/123 AA; 75/123 G; 75/123 R; 75/126 M; 75/126 L; 75/128 P; 75/126 G

[58] Field of Search ..... 75/124, 123 AA, 123 R, 75/123 G, 126 M, 126 L, 126 G, 128 P, 128 K

[56] References Cited

U.S. PATENT DOCUMENTS

| | | | |
|---|---|---|---|
| 2,236,716 | 4/1941 | Morris | 75/123 AA |
| 3,634,074 | 1/1972 | Ito et al. | 75/123 AA |
| 3,861,906 | 1/1975 | Tipnis et al. | 75/124 |
| 4,004,922 | 1/1977 | Thivellier et al. | 75/123 AA |
| 4,032,333 | 6/1977 | Josefsson | 75/123 AA |
| 4,091,147 | 5/1978 | Kanazawa et al. | 75/123 AA |

FOREIGN PATENT DOCUMENTS

| | | | |
|---|---|---|---|
| 2146194 | 3/1972 | Fed. Rep. of Germany | 75/123 AA |

*Primary Examiner*—L. Dewayne Rutledge
*Assistant Examiner*—Upendra Roy
*Attorney, Agent, or Firm*—Kenyon & Kenyon

[57] ABSTRACT

The fine-grained structural steel of the invention, having improved machinability and good mechanical properties, contains, in addition to iron and carbon, the following elements in the following by weight proportions: Mn 0.3 to 2%; S 0.02 to 0.10%; Te 14 to 130 ppm; Ca 2 to 18 ppm; Al 0.01 to 0.05%; the weight Te/S ratio ranging from 0.07 to 0.13, preferably 0.09 to 0.11.

5 Claims, 4 Drawing Figures

MAGNESIUM-FREE, FINE-GRAINED STRUCTURAL STEEL WITH IMPROVED MACHINABILITY AND WORKABILITY

The present invention relates essentially to a fine-grained structural steel with better workability or improved machinability. More specifically the invention is directed to an alloy with sharply improved workability within a wide range of machining requirements corresponding in particular to the capability of using any cutting speeds ranging from low speeds to very high speeds, such an alloy simultaneously exhibiting good mechanical properties including good characteristics in a direction at right angles to the rolling direction.

The invention relates moreover to a method of making or manufacturing said structural steel.

There are already known steels suitable for being machined or worked and to which have been added elements such as sulphur, selenium, tellurium, lead, bismuth or the like which would improve their suitability for or capability of being cut. A number of such elements however are expensive and do not act effectively upon workability or machinability at low and medium cutting speeds. Moreover it has been found that such additions which give rise to thread-like inclusions of sulphides or like sulphide inclusion stringers, of the MnS type for instance, would exert a more or less marked harmful effect upon the mechanical properties, in particular upon the characteristics in the transversely extending direction (at right angles to the rolling direction) as well as upon the hardenability.

With a view to attempting to overcome these drawbacks it has been tried to substitute for the conventional deoxidation with aluminum, silicon-supported or calcium-supported deoxidation processes with the purpose of obtaining a distribution and/or morphology of the oxides more conductive to improving the mechanical properties and the workability or machinability at any rates of the cutting speed, but the object aimed at could not be accomplished.

As a matter of fact:

(a) The silicon-supported and the calcium-supported deoxidation would result in rather fusible silicate-type inclusions which form a protective film or skin between the cutting tool and the steel chips when the steel is being machined and which thus would improve the workability thereof. This advantage is however significant only under very particular cutting conditions, namely: high cutting speeds with a tool made from tungsten carbide, thereby limiting the interest in such a steel which, besides, is of a lower cost price than those mentioned hereinabove, the workability of which would be improved through addition of elements such as sulphur.

Furthermore the steel deoxidized with silicon and with calcium does not contain, or only contains very little, aluminum and is therefore very sensitive to an increase in grain size; it may accordingly not be used every time the grain size has to be kept fine, as is the case when it is desired to carry out a deep carburization or deep case-hardening of the steel.

(b) The aluminum-supported and calcium-supported deoxidation results in fine-grained steels with improved workability owing to the coating or covering of aluminum oxide (or aluminum oxide+calcium oxide) inclusions referred to hereinafter as "aluminocalcium" inclusions, with manganese calcium sulphides, such sulphides preventing the abrasive effects of said inclusions upon the cutting tool from appearing.

With a view however to achieving the highest machining performances at medium cutting speeds, such steels much comprise an adequate sulphur (or sulphur group elements) content; so that a substantial sulphur part is not combined with the calcium and is present as MnS type sulphides, forming thread-like inclusions or inclusion stringers which results in bad mechanical properties, especially in the transverse direction, and in a bad or poor hardenability.

Moreover due to the calcium contents which are used in aluminum supported and calcium-supported deoxidation the aforesaid inclusions of oxides may be of very large sizes (for instance of about 50 micromillimeters for steels containing at least 125 ppm—parts in one million—of calcium), and this would result in a very bad behaviour of such steels under fatigue constraints.

It is therefore not possible to increase the calcium content with a view to reducing, through combination of that calcium with sulphur, the available sulphur amount which forms sulphides constituting unfavourable thread-like inclusions or inclusion stringers.

A main object of the present invention is to remove the aforesaid inconveniences and to provide a steel exhibiting at the same time a very good machinability at all cutting speeds as well as good mechanical properties including those in a transverse direction with respect to the rolling direction and a good hardenability.

The steel according to the invention is characterized in that it contains in addition to iron and carbon at least the following elements with the stated weight ratios:

manganese: 0.3% to 2% in weight
sulphur: 0.02% to 0.10% in weight
tellurium: 14 to 130 ppm in weight
calcium: 2 to 18 ppm and preferably from 2 to 15 ppm in weight
aluminum: 0.01% to 0.05% in weight, the tellurium/sulphur weight ratio being within the range between 0.07 and 0.13, and preferably between 0.09 and 0.11; in a particular embodiment the tellurium/sulphur weight ratio is of about 0.10.

The method of making the structural steel according to the invention is characterized in that it comprises the steps of killing the carbon steel melt, containing manganese and possibly silicon, with aluminum and adding calcium, tellurium and sulphur into that melt, these elements being added in amounts such that the final contents of the various following elements be as follows:

manganese: 0.3% to 2% in weight
sulphur: 0.02% to 0.10% in weight
tellurium: 14 to 130 ppm in weight
calcium: 2 to 18 ppm in weight and preferably from 2 to 15 ppm in weight
aluminum: 0.01% to 0.05% in weight, the tellurium/sulphur weight ratio being within the range between 0.07 and 0.13, and preferably between 0.09 and 0.11.

According to the present invention the carbon content may for instance range from 0.05% to 1.20% and the silicon content from 0.15% and 2% and preferably from 0.15% to 1.5%.

With the composition of the alloy according to the present invention it is possible to obtain essentially globular inclusions of oxides and sulphides comprising:

globular inclusions of calcium substituted alumina and/or of calcium aluminate not very rich in calcium, which are coated or covered with an outer layer consisting essentially of manganese sulphide and of calcium sulphide;

globular inclusions consisting essentially of manganese sulphotelluride.

The globular shape of all oxide-type or sulphide-type inclusions as well as the nature, the amount, the size and/or the distribution of said inclusions account for the simultaneous obtainment of the mechanical and workability qualities mentioned hereinabove.

A least sulphur content of 0.02% in weight is required to improve the machinability to a significant extent. Beyond 0.1% in weight the sulphur, even in the state of sulphides forming globular inclusions according to the invention, may reduce the mechanical properties and the hardenability of the steel.

Tellurium added in the relative amounts stated and so as to comply with the requirement of having the stated Te/S weight ratio enables the control of the morphology of the MnS type inclusions of sulphides (sulphides not combined with calcium) through globularization of said inclusions.

Such a control of the sulphide inclusions offers several advantages:

It is universally admitted that at a same sulphur content the globular sulphides would exert a more favourable action upon the machinability than the thread-like sulphides. Thus the steels according to the invention exhibit at an equal sulphur content a better machinability than that of conventional structural steels.

During the usual manufacturing processes the manganese sulphide inclusions, which are very plastic in a hot condition, would grow longer or stretch themselves out in the rolling direction and impart a fibrous structure to the wrought or welded products. The metal then exhibits very directional properties, that is, mechanical characteristics in a transverse direction (at right angles to the fibres) which are definitely lower than the characteristics in a longitudinal direction (in parallel relation to the fibres). Therefore the anisotropy (measured as the ratio of the deformation capacity or impact strength level in the longitudinal direction to that in the transverse direction) rapidly increases as soon as the smallest sulphur contents are present. The globularization and the better distribution of the sulphide inclusions enable a substantial mitigation of the consequence of fibration to be achieved and accordingly a substantial improvement in the isotropy of the mechanical properties of the metal. This established result holds true for steels exhibiting very differing strength levels, for instance for those the strength Rm of which is within the range between 600 $N/mm^2$ and 1,500 $N/mm^2$.

Tellurium would directly combine with the sulphides without preferentially fixing oxygen; the use of the adequate Te/S weight ratio is therefore not influenced by the steel deoxidation conditions.

As a general rule tellurium would impair the hot-deformability of the metal to a much more significant extent than sulphur or selenium. Such an impairment would make difficult the denaturation of the ingots into half-wrought materials or like semi-finished or intermediate products and would limit the development of steel grades containing about 0.05% in weight of tellurium. The steel according to the present invention does therefore not show that inconvenience due to a maximum tellurium content which is of 0.013% only.

On the other hand the impoverishment in manganese of the matrix pursuant to the formation of manganese tellurides may effect the hardenability of those grades which contain for instance about 0.05% in weight of tellurium and lead to a substantial decrease in the mechanical characteristics under the same or like conditions of thermal treatment. In view of the small tellurium content of the steel according to the invention such a drawback is removed.

The inventor has already shown that with structural steels, the tellurium content of which is within a range between 0.04% and 0.08% in weight, it is possible to substantially improve the forgeability and hardenability of said steels while using a Mn/Te weight ratio above 15. With the lower tellurium content (0.0014% to 0.013%) of the steel according to the invention) it is possible to comply with said weight ratio without altering the basic chemical composition and in particular without changing the manganese content prescribed by the standards in force for the structural steels. Such steels do therefore not exhibit the aforementioned inconveniences.

In view of the smaller amount of tellurium added, the steel is of a lower cost price than those of the other structural steels wherein the sulphides are controlled.

A calcium content of 2 to 18 ppm (parts in one million, in weight) in the steel is adequate to convert the major part of the alumina inclusions into aluminate inclusions which are little calcium-substituted, and thereby to remove the major part of the strings of alumina inclusions which are usually found in steels killed with aluminum. An oxide inclusion which is representative of a steel according to the invention and contains 0.01% to 0.05% in weight of aluminum and 2 to 18 ppm of calcium, consists of alumina which is little calcium oxide (CaO)—substituted (10% to 12% in weight at most) and/or of the compound 6 $Al_2O_3$, CaO. This calcium content is also adequate to form manganese calcium sulphides or (Mn, Ca) S type substituted sulphides, the outstanding feature of which is to coat or encapsulate the aforesaid oxide-type inclusions. Thus the modification of the nature of the oxide and/or this pattern of combined oxide-sulphide inclusions would contribute to improve the machinability by substantially reducing the abrasive character of alumina with respect to the tool.

A calcium content in the steel higher than 18 ppm is of no additional interest for the control of the morphology of the sulphides, since those which are not combined with or changed by calcium are globularized by the tellurium as stated previously. On the other hand a larger calcium content suffers from the major inconvenience of resulting in the formation of aluminocalcium inclusions of a size and kind which are particularly harmful to the behaviour under fatigue conditions of the high-duty or high-strength, quenched and subsequently tempered or treated (case-hardened or carbonized or carbonitrided) structural steels.

An aluminum content within the range between 0.01% and 0.05% would correspond to the usual content bracket for that element so as to perform deoxidation suitably and provide a fine-grained steel.

The steel according to the invention may also be a low-alloy steel comprising small amounts of additional elements such as chromium, nickel, molybdenum, vanadium, tungsten etc. in particular in the following relative amounts: Cr (up to 5% in weight), Ni (up to 5% in weight), Mo (up to 2% in weight), V (up to 1% in weight).

The invention will be better understood and further objects, characterizing features, details and advantages thereof will appear more clearly as the following explanatory description proceeds with reference to the accompanying diagrammatic drawings given by way of non-limiting examples only, illustrating several presently preferred specific embodiments of the invention and wherein:

FIG. 1*a* shows a diagram illustrating the machinability index of various steels;

FIG. 1*b* shows a diagram illustrating the life time (expressed in minutes) of a cutting tool;

FIG. 2 is a chart graphically showing the tool life time (expressed in minutes and plotted in ordinates) versus the cutting speed Vc (expressed in m/mn and plotted in abscissae) in relation to a cutting test; and FIG. 3 is similar to FIG. 2 but shows the results of a milling test.

EXAMPLE 1

A steel according to the invention is the steel called CGR herein and having the following composition:

carbon: 0.37% in weight
manganese: 0.71% in weight
silicon: 0.25% in weight
sulphur: 0.076% in weight
tellurium: 70 ppm (in weight)
calcium: 11 ppm (in weight)
aluminum: 0.03% in weight
iron and usual impurities: balance or remaining percentage, the Te/S weight ratio here being equal to 0.09.

This steel has been obtained in a conventional manner by carrying out a deoxidation with aluminum and thereafter in accordance with the invention additions of calcium, tellurium and sulphur have been made so as to obtain the final contents stated hereinabove.

Upon running tests of machinability and for determining of the mechanical characteristics set forth hereinafter this steel has been compared with the following steels:

(a) steel according to the French standard AFNOR XC 38, type U, with a sulphur content of 0.03%, manufactured under the usual conditions which steel is referred to hereinafter as "base") and having the following composition:

carbon: 0.38% in weight
manganese: 0.68% in weight
silicon: 0.30% in weight
sulphur: 0.031% in weight
aluminum: 0.02% in weight and wherein the sulphides form thread-like inclusions.

(b) steel, the basic composition of which is the same as the composition of the foregoing steel but which has been manufactured by using calcium (referred to hereinafter as "C" steel) and which has the following composition:

carbon: 0.38% in weight
manganese: 0.68% in weight
silicon: 0.30% in weight
sulphur: 0.031% in weight
aluminum: 0.02% in weight
calcium: 10 ppm.

(c) steel according to the French standard AFNOR XC 38, killed with aluminum and subjected to a resulphurization treatment so as to provide a final sulphur content of 0.076%, this steel being referred to hereinafter as "GR" and having the following composition after the resulphurization step:

carbon: 0.37% in weight
manganese: 0.71% in weight
silicon: 0.25% in weight
sulphur: 0.076% in weight
tellurium: 70 ppm (in weight)
aluminum: 0.03% in weight (d) steel according to the French standard AFNOR XC 38, type U, with a sulphur content of 0.03%, silicon-killed and calcium-killed (steel referred to hereinafter as "A") and having the following composition:

carbon: 0.39% in weight
manganese: 0.65% in weight
silicon: 0.35% in weight
sulphur: 0.028% in weight
calcium: 45 ppm.

Tests No. 1: Machinability tests at medium cutting speed with a high-speed steel cutting tool.

FIG. 1*a* of the accompanying drawings illustrates the machinability index for the following steels: base, C, A, GR and CGR, this index being proportional to the "tool dying" speed during a turning test continuously performed on a cone at gradually accelerated cutting speed; the index value 100 is assigned to the base. Depth of cut: 2 mm.

FIG. 1*b* shows the life time of the cutting tool expressed in minutes during a cutting test (this life time corresponds to a clearance or undercut wear depth $V_B$ of 0.3 mm). Cutting speed: 40 m/mn. Depth of cut: 4 mm.

FIG. 1*a* depicts an improvement in machinability of about 30% with the resulphurized grades in which the sulphides form globular inclusions in the presence or in the absence of calcium (CGR and GR steels, respectively).

This improvement is proved by the results of the cutting test shown on FIG. 2, the tool life time being multiplied with a factor of about 3 for the GR and CGR steels with respect to the base and to the A steel.

Thus at the medium cutting speeds used in the aforementioned tests the sulphur content and the control of the morphology of the sulphide inclusions are two essential parameters.

Tests No. 2: Machinability tests at high cutting speed with a tungsten carbide tool.

Figure 1A:
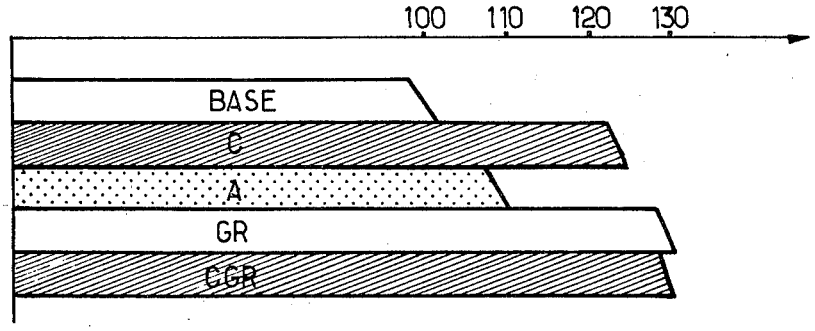
Figure 1B:
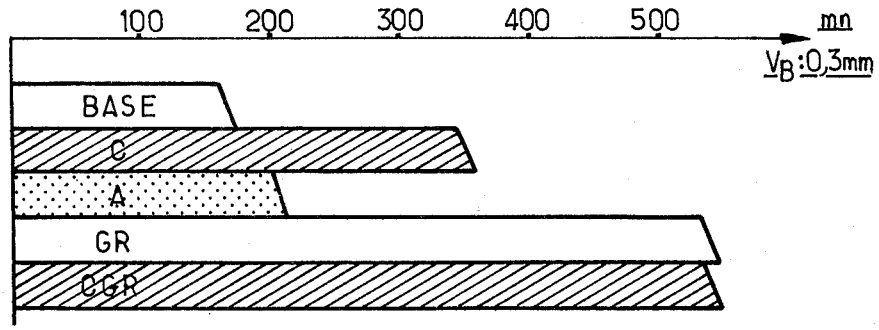
Figure 2:
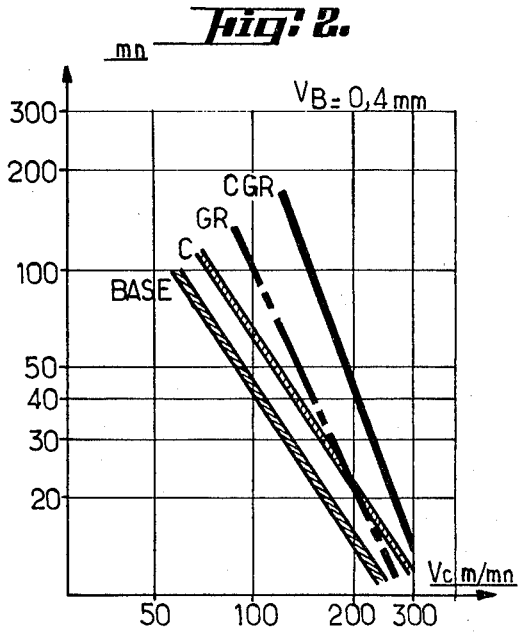
FIG. 2 is a chart showing for the base and the C, GR and CGR steels, respectively, the turning time (in minutes) for an undercut or clearance wear $V_B$ of 0.4 mm plotted against the cutting speed $V_C$ (in meters per minute). Depth of cut: 1.5 mm.

When considering FIG. 2 it is seen that the resulphurized steel without calcium (GR steel) provides a substantial gain in machinability but which will be quickly attenuated when the cutting speed increases. It is seen indeed that the beneficial effect of sulphur becomes less and less sensitive and vanishes practically when the cutting speed is exceeding 250 meters per minute.

With respect to the GR steel, the CGR steel according to the invention provides a gain in cutting speed of about 30% for a same tool life time or a gain of about 50% to 100% in the tool life time for a same cutting speed.

Figure 3:
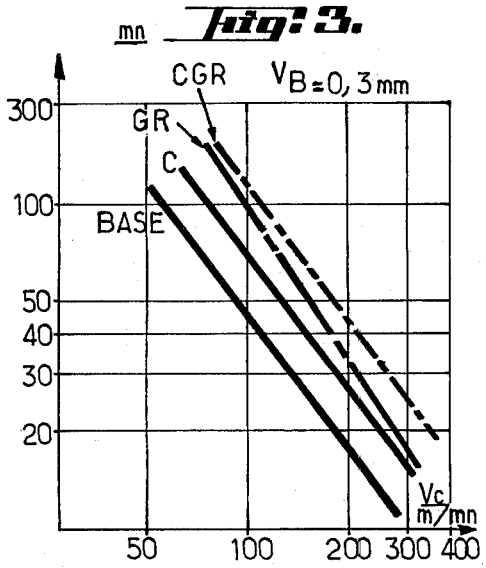
FIG. 3 is a chart showing the milling time (in minutes) for the base and the C, GR, CGR and A steels, respectively, plotted against the tool cutting speed $V_C$ in meters per minute for a clearance or undercut wear $V_B$ of 0.3 mm. Depth of cut: 2 mm.

Like observations may be made in relation to the milling test, the results of which are shown in FIG. 3, from which it appears that the advantage of the CGR steel over the GR steel becomes outstanding especially at high cutting speeds.

FIGS. 2 and 3 therefore show the beneficial effect of a small addition of calcium into aluminum-killed steels having undergone an adequate resulphurization and exhibiting a tellurium/sulphur weight ratio in a range between 0.07 and 0.13 as is the case with the CGR steel according to the invention.

Test No. 3: Tests for the determination of the mechanical properties (operating characteristics).

Table I gives the mechanical characteristics of machinability of the C, GR, CGR and base steels, respectively, after treatment carried out to achieve a strength $R_m$ of about 1,000 N/mm$^2$. It is seen that the mechanical properties are quite comparable for all the steels disclosed in table I. In particular the properties relating to ductility, impact strength and fatigue-resistance in a transverse direction with respect to the rolling direction are retained in spite of a relatively high sulphur content. Only the properties in the lengthwise direction, that is, in parallel relation to the rolling direction, are slightly less good for the CGR steel according to the present invention and for the GR steel, taking into account the globularization of the sulphides (lower L/T anisotropy ratio for such alloys than for the C and base alloys).

The responses to heat treatments and to the sensitivity to grain-size increase besides are the same for the three aluminum-killed steels, i.e. the C and GR steels and the CGR alloy according to the invention.

Table II discloses for the A, C, GR, CGR and the base steels, respectively, the observed trends with respect to machinability, mechanical properties, hardenability and grain-size increase or growth and this with reference to the base considered as a standard (sign 0), the signs +, =, − indicating the sense of the evolution of the performance observed; the number of signs specifies whether the trend is more or less marked.

Hereinafter are given the compositions of further steels according to the present invention:

EXAMPLE 2 carbon: 0.39% in weight
manganese: 0.90% in weight
silicon: 0.25% in weight
sulphur: 0.080% in weight
tellurium 80 ppm in weight
calcium: 15 ppm in weight
aluminum: 0.02% in weight
iron: balance or remaining percentage

EXAMPLE 3 carbon: 0.20% in weight
manganese: 0.85% in weight
silicon: 0.28% in weight
nickel: 0.60% in weight
chromium: 0.55% in weight
molybdenum: 0.25% in weight
sulphur: 0.075% in weight
tellurium: 70 ppm in weight
calcium: 12 ppm in weight
aluminum: 0.03% in weight
iron: balance or residual percentage

EXAMPLE 4 carbon: 0.16% in weight
manganese: 0.95% in weight
silicon: 0.30% in weight
nickel: 1.50% in weight
chromium: 1.10% in weight
sulphur: 0.090% in weight
tellurium: 90 ppm in weight
calcium: 10 ppm in weight
aluminum: 0.03% in weight
iron: balance or residual percentage.

The steels according to the invention exhibit a substantial gain in machinability for very extended machining conditions and modes. On the other hand the simultaneous control of the globular pattern of the sulphide-type inclusions and of the oxide-type inclusions enables the operating characteristics (mechanical properties, hardenability, grain size) of the steels according to the invention to be related at the same level as those of the other steels considered.

Table I

| | | | | Mechanical operating characteristics | | | | | | |
|---|---|---|---|---|---|---|---|---|---|---|
| | | | | | Ductility | | | Fatigue | | |
| Steel type | AFNOR grade | S% | Direction | Treated for $R_m$ (N/mm$^2$) | sectional area reduction (in %) | KCU (+20° C.) (J/cm$^2$) | Treated for $R_m$ equal to (in N/mm$^2$) | $\sigma D^{50\%}$ (in N/mm$^2$) | $\lambda$ (in N/mm$^2$) | $\sigma D/Rm$ endurance ratio |
| base | XC 38 | 0.031 | L* | 980 | 65 | 92 | 980 | 550 | 20 | 0.56 |
| | | | T** | 980 | 19 | 20 | 940 | 360 | 20 | 0.38 |
| C | XC 38 | 0.031 | L | 920 | 66 | 94 | 920 | 500 | 45 | 0.54 |
| | | | T | 920 | 27 | 25 | | | | |
| GR | XC 38 | 0.076 | L | 980 | 55 | 70 | 980 | 490 | 10 | 0.50 |
| | | | T | 980 | 19 | 20 | 980 | 380 | 5 | 0.39 |
| CGR | XC 38 | 0.076 | L | 960 | 54 | 75 | 980 | 480 | 35 | 0.49 |
| | | | T | 960 | 20 | 22 | 980 | 380 | 35 | 0.39 |

*L = property in the lengthwise direction (parallel to the rolling direction)
**T = property in the transverse direction (at right angles to the rolling direction)
Ductility
- sectional area reduction Σ in %: percentage decrease in the section of the test piece after tensile break or failure
- KCU (+20° C.): breaking energy level on impact test piece formed with a U-shaped notch
Fatigue
- $\sigma D^{50\%}$: fatigue limit determined at 50% of non-failure by the "staircases" method. Rotary bending test at $10^7$ cycles.
λ: standard deviation at fatigue limit.

Table II

| Characteristics | | | | Base | A | C | GR | Steel kind CGR |
|---|---|---|---|---|---|---|---|---|
| MACHINING | CUTTING PERFORMANCES | TOOL CARBIDE P 30 | TURNING | O | +++ | + | + | ++ |
| | | | MILLING | 0 | +++ | + | + | ++ |
| | | TOOL HIGH-SPEED STEEL 6.6.2 | TURNING | 0 | + | ++ | ++ | ++ |
| | | | CUTTING | 0 | + | ++ | +++ | +++ |
| | CHIP FRAGMENTATION | TOOL CARBIDE | TURNING | 0 | + | = | + | + |
| MECHANICAL PROPERTIES | DUCTILITY | QUENCH-TEMPER STATE | Sectional area reduction in lengthwise direction | 0 | − | = | − | − |
| | | | Sectional area reduction in transverse direction | 0 | = | + | = | = |
| | | | KCU in lengthwise direction | 0 | − | = | − | − |
| | | | KCU in transverse direction | 0 | = | + | = | = |
| | FATIGUE rotary bending | for Rm = 1,000 N/mm² | $\sigma_D$ in lengthwise direction | 0 | = | = | − | − |
| | | | $\sigma_D$ in transverse direction | 0 | = | = | = | = |
| | COLD | annealed/normalized state | crushing | 0 | = | + | − | − |
| | DEFORMABILITY | annealed/normalized | twist + tensile | 0 | | + | − | − |
| HARDENABILITY | | Jominy - U-shaped curve | | 0 | = | = | = | = |
| INCREASE IN GRAIN SIZE | | at 900° to 1,100° C. | | 0 | − | = | = | = |

It should be understood that the present invention is not at all limited to the embodiments described and shown which have been given by way of illustrative examples only. In particular it comprises all the means constituting technical equivalents of the means described as well as their combinations if same are carried out according to its gist and used within the scope of the appended claims.

What is claimed is:

1. A fine-grained structural steel composition having improved machinability and good mechanical properties, said steel consisting essentially of the following elements in the following percentage ranges, by weight:

| | |
|---|---|
| C | 0.05–0.7 |
| Mn | 0.3–2 |
| S | 0.02–0.10 |
| Te | 0.0014–0.013 |
| Ca | 0.0002–0.0018 |
| Al | 0.01–0.05 |
| Si | 0.15–2 |
| Cr | 0–5 |
| Ni | 0–5 |

-continued

| | |
|---|---|
| Mo | 0–2 |
| V | 0–1 |
| Fe | balance, |

wherein the weight ratio of tellurium to sulphur is in a range between 0.07 and 0.13, and wherein oxide and sulphide inclusions are essentially of the globular type and comprise calcium aluminate inclusions containing little Ca and coated with an outer layer consisting essentially of manganese and calcium sulphide and globular inclusions consisting essentially of manganese sulphotelluride.

2. A steel composition according to claim 1 wherein the weight ratio of tellurium to sulphur is between 0.09 and 0.11.

3. A steel composition according to claim 1 wherein the proportion of calcium by weight is in the range between 2 and 15 ppm.

4. A steel composition according to claim 1, wherein said oxide inclusions have approximately the following composition: 6 $Al_2O_3$,CaO.

5. A steel composition according to claim 2 wherein the tellurium to sulphur weight ratio is about 0.10.

* * * * *

UNITED STATES PATENT AND TRADEMARK OFFICE

CERTIFICATE OF CORRECTION

PATENT NO. : 4,210,444

DATED : July 1, 1980

INVENTOR(S) : Jean Bellot

It is certified that error appears in the above—identified patent and that said Letters Patent is hereby corrected as shown below:

Column 2, line 5: "much" should be --must--.

Column 2, line 62: "and" (first occurrence) should be --to--.

Column 4, line 14: after "invention" the closing parenthesis ")" should be deleted.

Column 5, line 43: after "conditions" an opening parenthesis --(-- should be inserted.

Column 8, line 44: "related" should be --retained--.

Signed and Sealed this

*Twenty-fifth* Day of *November 1980*

[SEAL]

*Attest:*

SIDNEY A. DIAMOND

*Attesting Officer*

*Commissioner of Patents and Trademarks*